US010075785B2

(12) United States Patent
Slocum et al.

(10) Patent No.: US 10,075,785 B2
(45) Date of Patent: Sep. 11, 2018

(54) EAR BUD HEADSET

(75) Inventors: Jeremy Slocum, Redmond, WA (US); Monika Wolf, Seattle, WA (US)

(73) Assignee: MICROSOFT TECHNOLOGY LICENSING, LLC, Redmond, WA (US)

( * ) Notice: Subject to any disclaimer, the term of this patent is extended or adjusted under 35 U.S.C. 154(b) by 728 days.

(21) Appl. No.: 13/540,933

(22) Filed: Jul. 3, 2012

(65) Prior Publication Data

US 2014/0010389 A1 Jan. 9, 2014

(51) Int. Cl.
*H04R 1/10* (2006.01)
*H04R 5/033* (2006.01)

(52) U.S. Cl.
CPC ..... *H04R 1/1066* (2013.01); *H04R 5/0335* (2013.01)

(58) Field of Classification Search
CPC ..... G02C 5/14; G02C 11/06; G02C 11/10; G02C 3/003; A61F 11/12; H04R 25/00; H04R 1/1066; H04R 1/10; H04R 5/0335; H04M 1/05; H04M 1/0335
See application file for complete search history.

(56) References Cited

U.S. PATENT DOCUMENTS 4,039,765 A * 8/1977 Tichy ..... H04M 1/05 379/430
4,455,457 A * 6/1984 Akira ..... H04R 5/0335 181/141
4,783,822 A * 11/1988 Toole ..... H04M 1/05 2/209
5,335,285 A * 8/1994 Gluz ..... 381/381
5,369,857 A 12/1994 Sacherman et al.
5,457,751 A 10/1995 Such
5,608,808 A * 3/1997 da Silva ..... G02C 11/10 351/123
6,333,982 B1 12/2001 Sapiejewski et al.
6,754,361 B1 6/2004 Hall et al.
7,050,598 B1 5/2006 Ham
7,457,428 B2 * 11/2008 Vaudrey ..... A61F 11/12 381/372
8,363,875 B2 * 1/2013 Ito et al. ..... 381/379
2002/0131585 A1 9/2002 Jones et al.
2005/0201585 A1 * 9/2005 Jannard ..... G02C 3/003 381/381

(Continued)

OTHER PUBLICATIONS

Serotsky, Paul, "A Bone of Contention" Retrieved at <<http://www musicweb-international.com/classrev/2009/Nov09/bone.htm>>, Retrieved Date: Apr. 16, 2012, 8 pages.

*Primary Examiner* — Fan Tsang
*Assistant Examiner* — Angelica M McKinney
(74) *Attorney, Agent, or Firm* — Alleman Hall Creasman & Tuttle LLP

(57) ABSTRACT

A headset comprising a head band assembly including a left-side head band curved to extend from a crown end toward a temple end at a left temple region of a wearer's head; a right-side head band curved to extend from the crown end toward a temple end at a right temple region of the wearer's head; an elbow including a first end coupled to the temple end of the left-side head band or the temple end of the right-side head band, a second end opposite the first end, and a bend between the first end and the second end; an ear bud stem pivotally coupled to the second end of the elbow; and an ear bud coupled to the ear bud stem.

19 Claims, 4 Drawing Sheets

(56) References Cited

U.S. PATENT DOCUMENTS

| | | | | |
|---|---|---|---|---|
| 2007/0003093 | A1* | 1/2007 | Ito et al. | 381/378 |
| 2007/0036386 | A1* | 2/2007 | Amae | 381/388 |
| 2007/0291220 | A1* | 12/2007 | Betts-Johnson | G02C 3/003 351/47 |
| 2008/0253604 | A1* | 10/2008 | Yamagishi et al. | 381/379 |
| 2009/0238397 | A1* | 9/2009 | Reiss et al. | 381/375 |
| 2010/0296684 | A1* | 11/2010 | Eberl et al. | 381/378 |
| 2011/0268308 | A1 | 11/2011 | Vasquez | |
| 2012/0140974 | A1* | 6/2012 | Danielson et al. | 381/379 |

* cited by examiner

EAR BUD HEADSET

BACKGROUND

Headsets are used to deliver selected sounds to a user's ear while at least partially blocking background sounds. However, prolonged use of headsets can be uncomfortable for some users because of ear sensitivity. Some previous approaches employ large earpieces that envelope the ear. However, such earpieces can be heavy, expensive, and unattractive.

SUMMARY

Various embodiments are disclosed that relate to a headset. One example headset comprises a head band assembly. The example head band assembly includes a left-side head band curved to extend from a crown end at a crown region of a wearer's head toward a temple end at a left temple region of the wearer's head and a right-side head band curved to extend from a crown end at the crown region of the wearer's head toward a temple end at a right temple region of the wearer's head. The example head band assembly also includes a hinge pivotally connecting the crown end of the left-side head band and the crown end of the right-side head band. The headset also comprises an elbow including a first end coupled to the temple end of the left-side head band or the temple end of the right-side head band, a second end opposite the first end, and a bend between the first end and the second end. The bend angles the second end toward a front of the wearer's head from a position on the wearer's head that is higher than an upper portion of a helix of the wearer's ear. The headset also comprises an ear bud stem pivotally coupled to the second end of the elbow so that the ear bud stem crosses a tragus of the wearer's ear when the ear bud stem is pivoted to an insertion position. An ear bud is coupled to the ear bud stem so that pivoting the ear bud stem to the insertion position causes the ear bud to be inserted into the concha cavum of the wearer's ear.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Headsets are used to deliver selected sounds to a user's ear while at least partially blocking background sounds. Some headsets include earpieces that press on the user's ear, causing some sensitive ear structures (e.g., the helix, ear lobe, and so on) to support and retain the headset in place during use. Over time, use of such headsets can become uncomfortable for some users because of the force of the earpiece on the ear. Some other headsets employ larger earpieces that envelope the ear so that the ear piece does not rest on the ear at all. However, these earpieces can be cumbersome and expensive, potentially requiring larger speakers to transmit sound through the larger volume of air outside of the ear. In turn, such headsets may be uncomfortable in their own right and possibly expensive as well.

Accordingly, the embodiments described herein are related to a headset designed to allow a user to obtain the benefit of a lightweight earbud-style headset, employing potentially lower-cost, lower-power speakers, without experiencing the potential discomfort that may result from pressure applied to sensitive portions of the user's ears.

Figure 1:
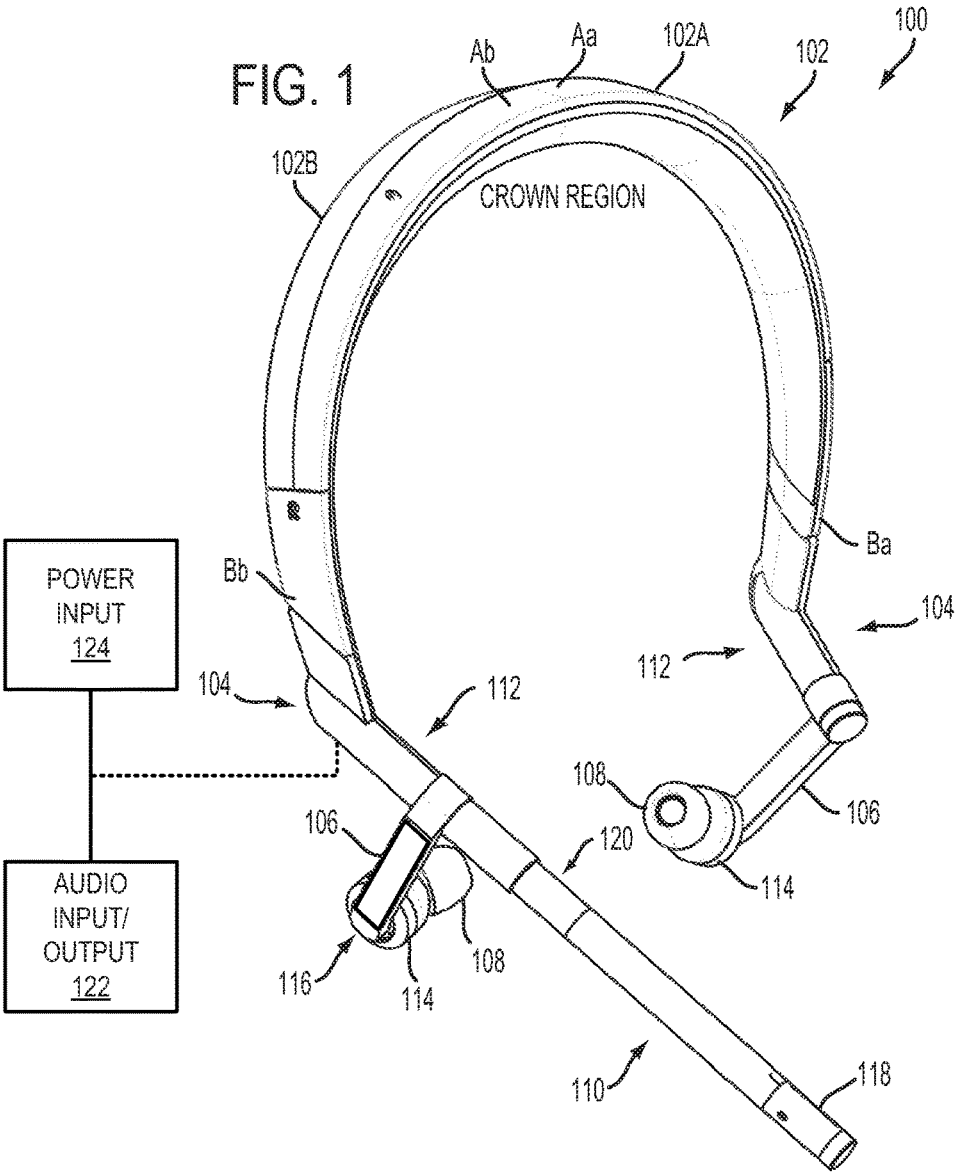
FIG. 1 shows an example headset according to an embodiment of the present disclosure.

FIG. 1 shows an embodiment of a headset 100 including a head band assembly 102, an elbow 104, an ear bud stem 106, an ear bud 108, and an optional microphone boom 110. While the embodiment of headset 100 shown in FIG. 1 is a stereo headset that includes ear buds 108 for a wearer's right and left ears, it will be appreciated that in some embodiments, headset 100 may be a mono headset that includes a single ear bud 108 configured for the left and/or the right ear. Thus, it will be appreciated that the principles described below with reference to a left-side or a right-side component may apply equally to a similar component positioned on the opposite side in some embodiments.

Figure 2:
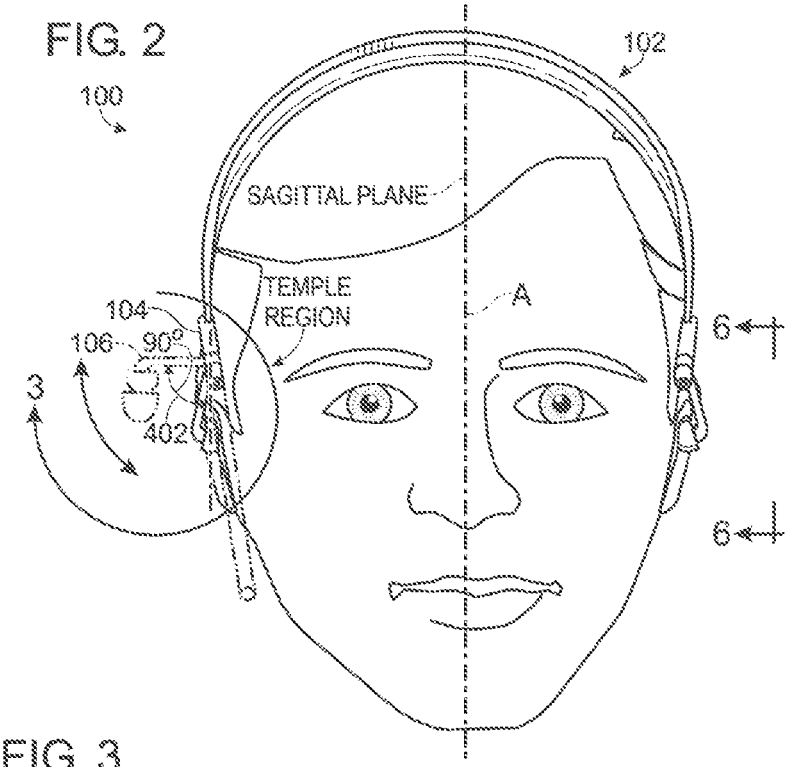
FIG. 2 shows the headset of FIG. 1 in an example use environment.

FIG. 2 shows an embodiment of headset 100 being worn by a wearer. For clarity, the wearer is not illustrated in FIGS. 1 and 4-5, and 7-9. The embodiment of headset 100 shown in FIG. 2 illustrates how an example right-side ear bud 108 may be pivoted in and out of a wearer's right ear, which may enhance user comfort. In the example shown in FIG. 2, right-side ear bud 108 is coupled to a right-side elbow 104 via a right-side ear bud stem 106. Right-side elbow 104 rests on a right temple region of the wearer's head in the embodiment shown in FIG. 2.

Each ear bud 108 is configured to be directed within a respective concha cavum of a wearer's ear when that ear bud is placed into an insertion position. Ear buds 108 include a sealing surface configured to mate with a user's ear to block at least a portion of background noise and. The ear buds 108 may also include one or more speakers.

Figure 3:
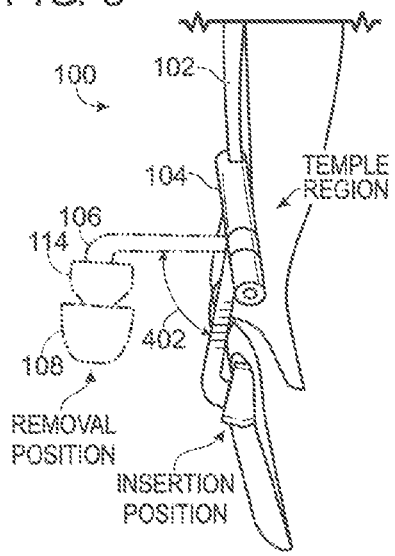
FIG. 3 shows a close-up view of the example use environment shown in FIG. 2 taken at detail circle 3.

Ear buds 108 are configured to freely pivot in and out of the ear. FIG. 3 shows a close-up view of right side elbow 104 and right-side ear bud stem 106 taken along detail circle 3 of FIG. 2.

In the example shown in FIG. 3, right-side ear bud stem 106 is depicted as being pivotally coupled to a second end of right-side elbow 104. In the example shown in FIG. 3, right-side ear bud 108 is illustrated in an insertion position in solid line and in a removal position in phantom line. Thus, right-side ear bud stem 106 may be pivoted in and out of the wearer's ear with little disturbance to right-side elbow 104.

Figure 5:
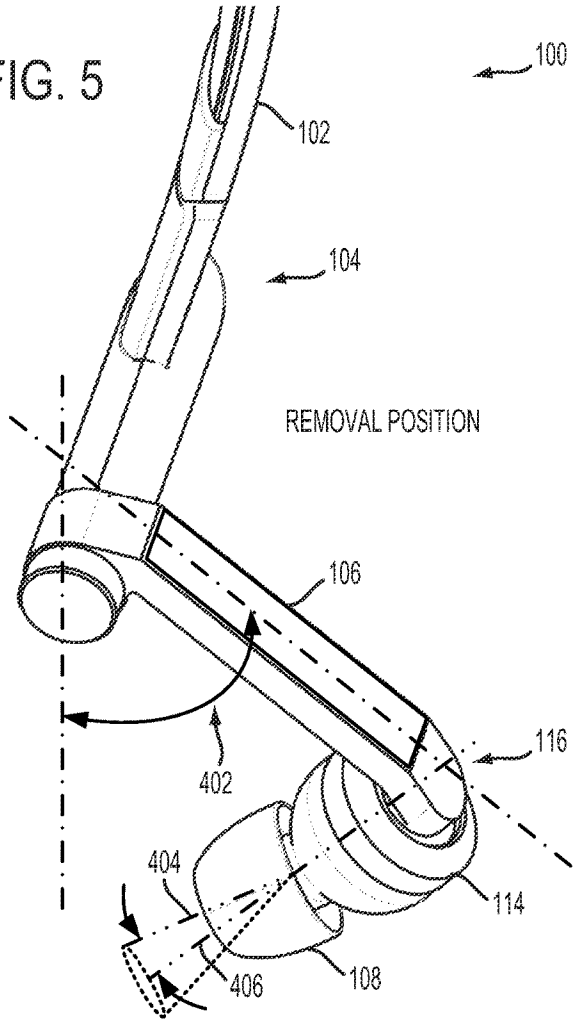
FIG. 5 shows the example ear bud stem of FIG. 1 in a removal position.
Figure 4:
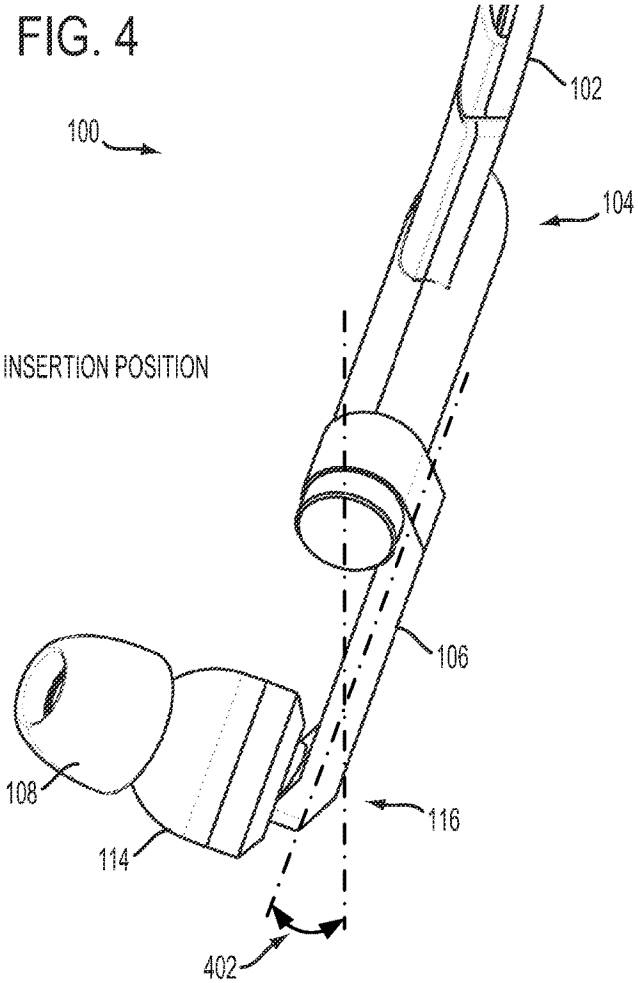
FIG. 4 shows an example ear bud stem of the headset of FIG. 1 in an insertion position.

FIGS. 4 and 5 show another example ear bud stem 106 pivotally coupled to elbow 104 in the insertion and removal positions, respectively. It will be appreciated that ear bud stem 106 may be pivoted through any suitable range of pivot angles 402. In some embodiments, ear bud stem 106 may be configured to be pivoted through a pivot angle 402 having a 120-degree range of motion with respect to elbow 104. For example, in one scenario, ear bud stem 106 may be pivoted 30 degrees or more inward (e.g., toward a wearer's head) and 90 degrees or more outward (e.g., away from a wearer's head) with respect to a sagittal plane passing through the wearer's head.

In some embodiments, a spring, friction surface, or other suitable manner of retaining an ear bud 108 in a selected position relative to elbow 104 may be provided. For example, a spring may couple ear bud stem 106 and elbow 104 so that the spring biases ear bud stem 106 with respect to elbow 104 to maintain ear bud stem 106 in the insertion position.

Figure 6:
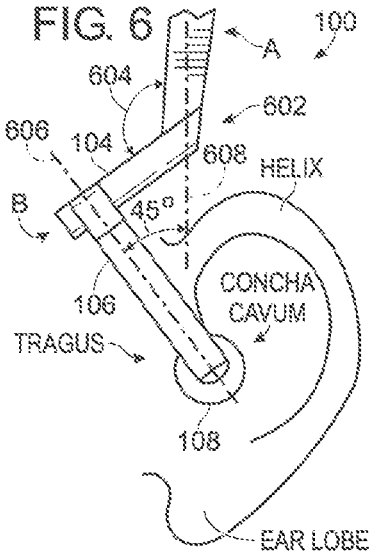
FIG. 6 shows a close-up view of the example use environment shown in FIG. 2 taken along view line 6-6.

Elbow 104 and ear bud stem 106 cooperate to direct ear bud 108 into the wearer's ear while avoiding portions of the ear that may be sensitive to prolonged contact. For example, FIG. 6 shows an example left-side ear bud stem 106 taken along detail line 6-6 in FIG. 2. In the example shown in FIG. 6, ear bud stem 106 crosses a tragus of the wearer's ear when ear bud 108 is pivoted to an insertion position. In turn, ear bud 108 may be comfortably worn without extended contact to sensitive portions of the ear, such as the helix and/or the ear lobe.

Headset 100 is supported on a temple region of the wearer's head, possibly avoiding uncomfortable user experiences associated with headsets that transfer weight to outer and/or inner portions of a user's ear. Turning back to FIG. 1, elbows 104 include temple support surfaces 112 that transfer at least a portion of a force imparted by headset 100 to a corresponding temple region of the wearer's head shown in FIG. 5. In turn, each ear bud 108 may freely pivot out of the insertion position while the respective elbow 104 remains in place. Because head band assembly 102 applies pressure to one or more temple regions to hold headset 100 in position on the wearer's head, pressure is not applied to ear buds 108. This may potentially avoid transferring the force of headset 100 to the ear canal through the ear buds and may also allow a user to remove one or both ear buds 108 without disturbing any adjustment to head band assembly 102

Further, elbow 104 is configured to angle toward a front of the wearer's head so that the ear bud may be inserted into the ear as described above. In the example shown in FIG. 6, left-side elbow 104 has a first end A coupled to the second end of left-side head band 102A and a second end B angled via a bend 602 with respect to first end A so that the second end extends toward a front of a wearer's head. In the embodiment shown in FIG. 9, bend 602 is positioned higher than an upper portion of a helix of the wearer's ear so that ear bud stem 106 pivots between the removal and insertion positions without contacting the helix, potentially improving comfort.

In some embodiments, bend 602 may include a setback angle 604 of between 120 and 150 degrees. Further, in some embodiments, a major axis 606 of ear bud stem 106, when projected on a sagittal plane, may be positioned within a range of 40 to 50 degrees from a projection of a line 608 bisecting left-side head band 102A onto the sagittal plane. In some settings, such as in stereo headsets where the left-side and right-side are mirror images of one another, major axis 606 of ear bud stem 106 projected on a sagittal plane may be positioned within a range of 40 to 50 degrees from a projection of line 608 bisecting head band assembly 102 onto the sagittal plane. In one non-limiting example, the major axis of ear bud stem 106 projected on a sagittal plane may be positioned to be 45 degrees from a projection of line 608 bisecting head band assembly 102 onto the sagittal plane.

Turning back to FIG. 1, head band assembly 102 includes a left-side head band 102A curved to extend from a first end Aa at a crown region of a wearer's head toward a second end Ba at a left temple region 110*a* of the wearer's head when worn by the wearer. Head band assembly 102 also includes a right-side head band 102B, curved to extend from a first end Ab at crown region toward a second end Bb at a right temple region 110*b* of the wearer's head.

In some embodiments, left-side head band 102A and right-side head band 102B may be coupled at least in part by a breadth adjustment that allows head band assembly 102 to be re-sized according to a bitragion width of a wearer's head. Moreover, the breadth adjustment may provide an additional bias force directing left-side head band 102A and right-side head band 102B toward the respective left and right temple regions of the wearer's head. If provided, a breadth adjustment may allow adjustment within any suitable range of widths. One non-limiting range includes widths from 124 mm to 155 mm as measured on a wearer's head.

Figure 7:
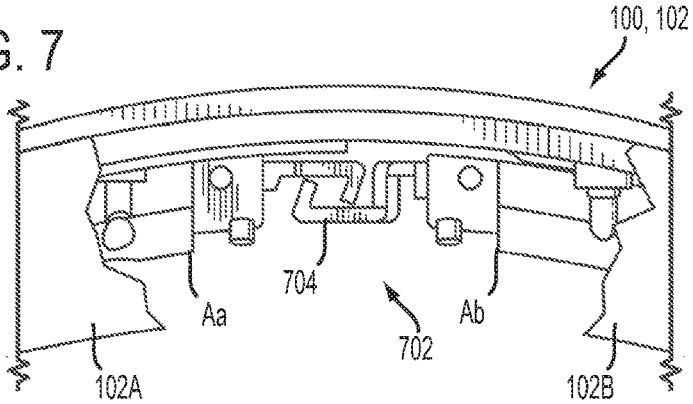
FIG. 7 shows a close-up view of an example width adjustment of the headset of FIG. 1.

FIG. 7 shows an embodiment of a width adjustment 702 included in an example head band assembly 102. In the embodiment shown in FIG. 7, width adjustment 702 is depicted as being disposed within an optional protective/decorative cover. If provided, a cover may protect width adjustment 702 from damage and/or may avoid pinching a user's scalp or snagging a user's hair, head covering, or the like. Width adjustment 702 may provide any suitable manner of adjusting a width of head band assembly 102. In the example shown in FIG. 7, width adjustment 702 includes a hook-and-slider mechanism 704 adapted to provide slidable width adjustment within a selected range. In some other embodiments, width adjustment 702 may include a hinge and/or a flexible member pivotally connecting left-side head band 102A to right-side head band 102B. Additionally, in some embodiments, a spring may be included to provide a restoring force for head band assembly 102, so that left-side head band 102A and right-side head band 102B are biased toward one another by the spring.

In some embodiments, headset 100 may also include a height adjustment that allows head band assembly 102 to be re-sized according to a height of a wearer's head. Moreover, the height adjustment may help direct forces from the ear canal to the temple region of the wearer's head. This also may potentially make extended wear of headset 100 more comfortable. If provided, a height adjustment may allow adjustment within any suitable range of widths.

Figure 9:
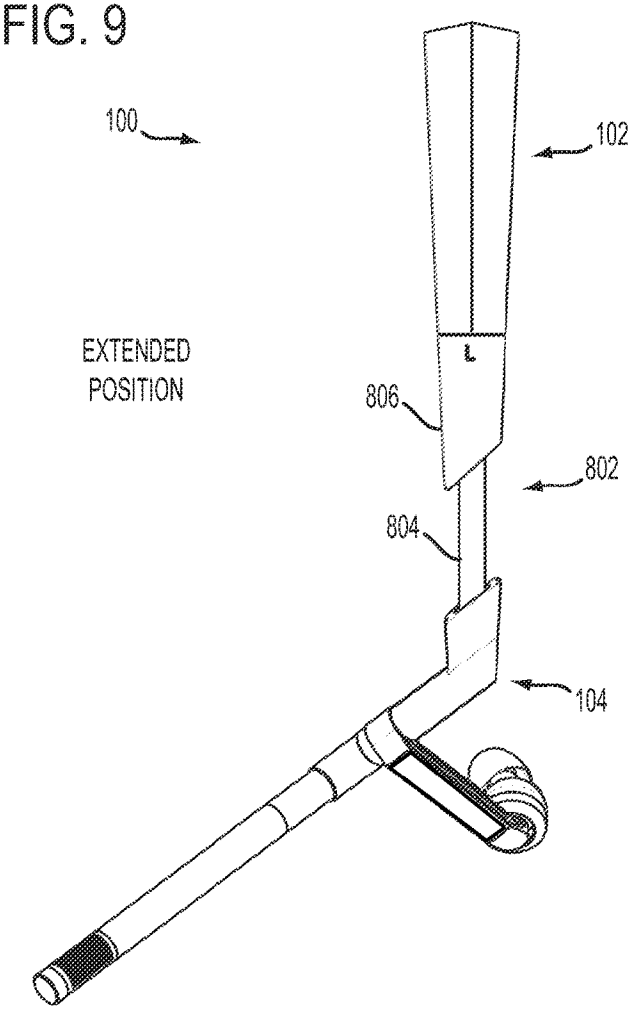
FIG. 9 shows a side view of the example headset size adjuster of FIG. 1 in an extended position.
Figure 8:
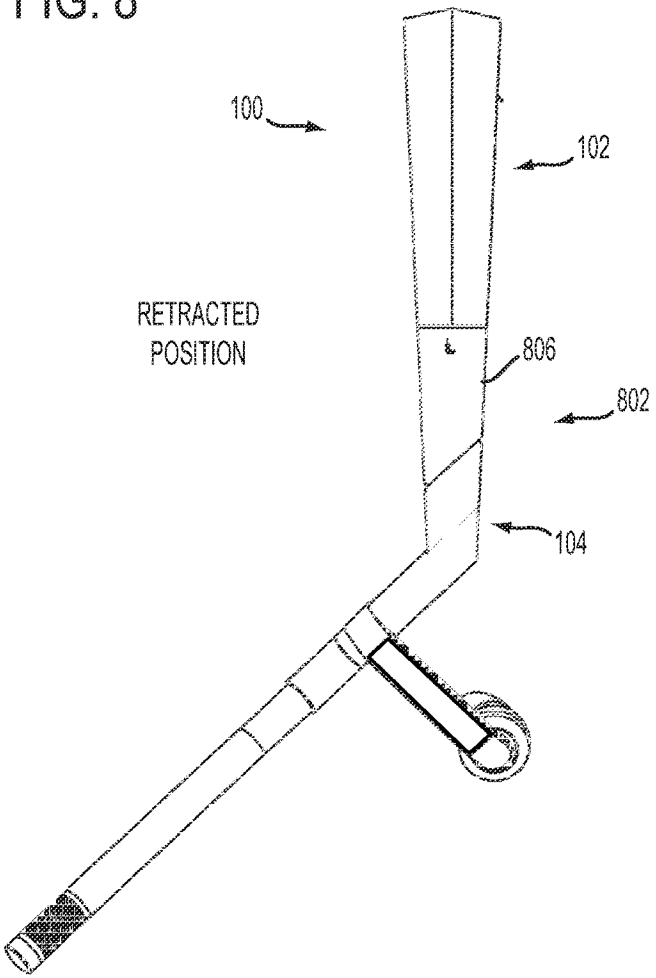
FIG. 8 shows a side view of an example headset size adjuster of the headset of FIG. 1 in a retracted position.

FIGS. 8 and 9 show a left-side view of headset 100 including a height adjustment 802. In the example shown in FIGS. 8 and 9, height adjustment 802 includes a size adjustment slide comprising a ladder 804 coupled to elbow 104 and a tunnel 806 included in left-side head band 102A. Ladder 804 is slidably disposed within tunnel 806. Retracting ladder 804 within tunnel 806, as shown in FIG. 8, reduces the height of headset 100; extending ladder 804 increases the height, as shown in FIG. 9. In some other embodiments, height adjustment 802 may include one or more gears and/or a gear rack, or any other suitable manner of adjusting the height of one or more elbows 104 relative to head band assembly 102. In some embodiments, height adjustment 802 may be configured to retain a selected setting so that a height adjustment remains as set until re-adjusted by a wearer. Any suitable structure configured to mechanically resist an unprompted change in height may be employed without departing from the scope of the present disclosure. Non-limiting examples include frictional surfaces, ratchets, and so on. Further, it will be appreciated that suitable protective and/or decorative covers may be provided in some embodiments.

Additional enjoyment may be realized from repositionable ear buds. Repositionable ear buds may allow a user to reorient one or more ear buds 108 to conform to gaps or pinch points within that wearer's ear, potentially relieving additional pressure between that ear bud and the wearer's ear over time. In some embodiments, ear bud 108 may be coupled rotatably to ear bud stem 106 so that ear bud 108 may be twisted/swiveled about the coupling. FIGS. 4 and 5 show an example ear bud coupling 114 positioned at an ear bud mounting location 116 on ear bud stem 106. In the example shown in FIGS. 4 and 5, ear bud 108 has a rotational axis 404 that is inclined slightly from a major axis 406 of ear bud coupling 114. In turn, rotating ear bud 108 about ear bud coupling 114 causes ear bud 108 to describe a portion of a cone around ear bud mounting location 116. Thus, an ear bud 108 having a symmetric cross section taken along its rotational axis of may be rotated into different positions. In some other embodiments, ear bud 108 may have a rotational axis parallel within major axis 406 and achieve similar results, such as those where ear bud 108 may have an asymmetric cross section taken along its rotational axis. Moreover, in some embodiments, ear bud coupling 114 may be configured as a removable coupling, so that ear bud 108 may be removed/replaced. In such embodiments, ear bud coupling 114 may include speaker components so that ear bud 108 may be removed/replaced without disturbing such portions.

In some embodiments, headset 100 may include optional microphone boom 110. Turning back to FIG. 1, microphone boom 110 is shown extending from right-side elbow 104, though it will be appreciated that microphone boom 110 may be configured to attach to either side of headset 100 in any suitable location. In some embodiments, microphone boom 110 may be configured to be removably attached to headset 100, while in some other embodiments microphone boom 110 may be permanently attached or integrated into headset 100.

In the example shown in FIG. 1, microphone boom 110 includes a sound inlet 118 at an opposite end from a location where microphone boom 110 is mounted to elbow 104. In some embodiments, a microphone may be included at sound inlet 118. In some other embodiments, sound may travel from sound inlet 118 up microphone boom 110 to a microphone mounted elsewhere. For example, in one scenario, microphone boom 110 may include a sound tube configured to direct sound from sound inlet 118 to a microphone included in elbow 104.

FIG. 1 depicts a position adjustment 120 for microphone boom 110. Position adjustment 120 may allow sound inlet 118 to be positioned in any suitable location relative to a user's mouth. This potentially may reduce inadvertent noises introduced from breathing, etc. For example, in some embodiments, position adjustment 120 may include a slide adjustment configured to permit length and/or rotation adjustment of microphone boom 110.

FIG. 1 also illustrates an audio input/output 122 and a power input 124. In some embodiments, audio input/output 122 may be configured to communicate audio signals from an audio source (e.g., a game console, a television, a computing device, a mobile device, etc.) to headset 100 via a suitable wired and/or wireless connection. In embodiments of headset 100 that include microphone boom 110, audio input/output 122 may be configured to transmit sounds received from sound inlet 118 to one or more audio sources via such connections as well.

Any suitable power source may be employed to power headset 100 without departing from the scope of the present disclosure. In some embodiments, headset 100 may be powered by a suitable remote power source (e.g., a power source not housed within headset 100) through power input 124. In some embodiments, headset 100 may be powered by a suitable on-board power source. In some embodiments, an on-board power source, such as a battery, may be recharged via intermittent connection to a remote power source through power input 124.

It is to be understood that the configurations and/or approaches described herein are exemplary in nature, and that these specific embodiments or examples are not to be considered in a limiting sense, because numerous variations are possible. The specific routines or methods described herein may represent one or more of any number of processing strategies. As such, various acts illustrated may be performed in the sequence illustrated, in other sequences, in parallel, or in some cases omitted. Likewise, the order of the above-described processes may be changed.

The subject matter of the present disclosure includes all novel and nonobvious combinations and subcombinations of the various processes, systems and configurations, and other features, functions, acts, and/or properties disclosed herein, as well as any and all equivalents thereof.

The invention claimed is:

1. A headset, comprising:

a head band assembly including:

a left-side head band curved to extend from a crown end at a crown region of a wearer's head toward a temple end at a left temple region of the wearer's head, a right-side head band curved to extend from a crown end at the crown region of the wearer's head toward a temple end at a right temple region of the wearer's head, and an elbow including:

a first end coupled to the temple end of the left-side head band or the temple end of the right-side head band, a second end opposite the first end, and a bend between the first end and the second end, the bend angling the second end toward a front of the wearer's head from a position on the wearer's head that is higher than an upper portion of a helix of the wearer's ear;

an ear bud stem pivotally coupled to the second end of the elbow so that the ear bud stem is pivotable between insertion and removal positions about an axis parallel to the second end of the elbow, and so that the ear bud stem crosses a tragus of the wearer's ear when the ear bud stem is pivoted to the insertion position;

and an ear bud coupled to the ear bud stem so that pivoting the ear bud stem to the insertion position causes the ear bud to be inserted into a concha cavum of the wearer's ear;

and a microphone boom extending from the elbow, the microphone boom remains stationary during pivoting of the ear bud stem.

2. The headset of claim 1, where the left-side head band and the right-side head band are biased toward one another by a width adjustment, the width adjustment including a hook-and-slider mechanism adapted to provide slidable width adjustment within a selected range limited by the hook-and-slider mechanism.

3. The headset of claim 2, further comprising:

a spring coupled to the left-side head band and the right-side head band at the width adjustment, the spring biasing the left-side head band and the right-side head band toward the respective left and right temple regions of the wearer's head;

a left-side size adjuster included in the left-side head band; and a right-side size adjuster included in the right-side head band.

4. The headset of claim 1, where the elbow includes a temple support surface that transfers at least a portion of a force imparted by the width adjustment to a corresponding temple region of the wearer's head so that the ear bud stem freely pivots out of the insertion position while the elbow remains in place.

5. The headset of claim 1, further comprising a spring coupled to the ear bud stem and the elbow, the spring biasing the ear bud stem with respect to the elbow to maintain the ear bud stem in the insertion position.

6. The headset of claim 1, further comprising a coupling rotatably joining the ear bud to an ear bud mounting location on the ear bud stem.

7. The headset of claim 6, where rotating the ear bud about the coupling causes the ear bud to describe a portion of a cone around the ear bud mounting location.

8. The headset of claim 1, where the ear bud stem is pivotally coupled to the second end of the elbow through a 120-degree range of motion.

9. The headset of claim 1, where a major axis of the ear bud stem, when projected on a sagittal plane, is positioned within a range of 40 to 50 degrees from a projection of a line bisecting the head band assembly on the sagittal plane.

10. The headset of claim 9, where the bend includes a setback angle of between 120 and 150 degrees.

11. A stereo headset, comprising:

a left-side head band, curved to extend from a first end at a crown region of a wearer's head toward a second end at a left temple region of the wearer's head when worn by the wearer;

a left-side elbow having a first end coupled to the second end of the left-side head band and a second end angled with respect to the first end so that the second end extends toward a front of a wearer's head when worn by the wearer;

a left-side ear bud stem pivotally coupled to the second end of the left-side elbow, so that the left-side ear bud stem is pivotable between insertion and removal positions about an axis parallel to the second end of the left-side elbow and crosses a tragus of the wearer's left ear when the left-side ear bud stem is pivoted to the insertion position;

a left-side ear bud coupled to the left-side ear bud stem so that pivoting the left-side ear bud stem to the insertion position causes the left-side ear bud to be inserted into a concha cavum of the wearer's left ear;

a right-side head band, curved to extend from a first end at a crown region of a wearer's head toward a second end at a right temple region of the wearer's head when worn by the wearer;

a right-side elbow having a first end coupled to the second end of the right-side head band and a second end angled with respect to the first end so that the second end extends toward a front of a wearer's head when worn by the wearer;

a right-side ear bud stem pivotally coupled to the second end of the right-side elbow, so that the right-side ear bud stem is pivotable between insertion and removal positions about an axis parallel to the second end of the right-side elbow while the right-side elbow remains stationary, and so that the right-side ear bud stem crosses a tragus of the wearer's right ear when the right-side ear bud stem is pivoted to the insertion position;

a right-side ear bud coupled to the right-side ear bud stem so that pivoting the right-side ear bud stem to the insertion position causes the right-side ear bud to be inserted into a concha cavum of the wearer's right ear; and a boom mountable to the second end of the left-side elbow or the second end of the right-side elbow at a first end of the boom such that the boom remains stationary during pivoting of the left-side ear bud stem and the right-side ear bud stem, the boom including a sound inlet for a microphone at a second, opposite end of the boom.

12. The stereo headset of claim 11, further comprising:

a left-side temple support surface included in the left-side elbow, the left-side temple support surface being adapted to transfer at least a portion of a force imparted by the left-side head band to a left-side temple region of the wearer's head so that the ear bud stem freely pivots out of the insertion position while the left-side elbow remains in place; and a right-side temple support surface included in the right-side elbow, the right-side temple support surface being adapted to transfer at least a portion of a force imparted by the right-side head band to a right-side temple region of the wearer's head so that the ear bud stem freely pivots out of the insertion position while the right-side elbow remains in place.

13. The stereo headset of claim 11, further comprising a hinge pivotally connecting the left-side head band and the right-side head band so that the left-side head band and the right-side head band are biased toward one another by the hinge.

14. The stereo headset of claim 11, further comprising:

a left-side coupling rotatably joining the left-side ear bud to a left-side ear bud mounting location on the left-side ear bud stem so that rotation of the left-side ear bud about the left-side coupling causes the left-side ear bud to describe a portion of a cone around the left-side ear bud mounting location; and a right-side coupling rotatably joining the right-side ear bud to a right-side ear bud mounting location on the right-side ear bud stem so that rotation of the right-side ear bud about the right-side coupling causes the right-side ear bud to describe a portion of a cone around the right-side ear bud mounting location.

15. The stereo headset of claim 11, where major axes of the left-side and right-side ear bud stems, when projected on a sagittal plane, are each positioned within a range of 40 to 50 degrees from a respective projection of a line bisecting the head band assembly on the sagittal plane.

16. The stereo headset of claim 11, where the left-side ear bud stem is pivotally coupled to the second end of the left-side elbow through a 120-degree range of motion and where the right-side ear bud stem is pivotally coupled to the second end of the right-side elbow through a 120-degree range of motion.

17. A stereo headset, comprising:

a left-side head band, curved to extend from a first end at a crown region of a wearer's head toward a second end at a left temple region of the wearer's head when worn by the wearer;

a left-side elbow having a first end coupled to the second end of the left-side head band and a second end angled with respect to the first end so that the second end extends toward a front of the wearer's head when worn by the wearer;

a left-side ear bud stem pivotally coupled to the second end of the left-side elbow, so that the left-side ear bud stem is pivotable between insertion and removal positions about an axis parallel to the second end of the left-side elbow and crosses a tragus of a wearer's left ear when the left-side ear bud stem is pivoted to the insertion position;

a left-side ear bud coupled to the left-side ear bud stem so that pivoting the left-side ear bud stem to the insertion position causes the left-side ear bud to be inserted into a concha cavum of the wearer's left ear;

a right-side head band, curved to extend from a first end at a crown region of the wearer's head toward a second end at a right temple region of the wearer's head when worn by the wearer;

a right-side elbow having a first end coupled to the second end of the right-side head band and a second end angled with respect to the first end so that the second end extends toward a front of the wearer's head when worn by the wearer;

a right-side ear bud stem pivotally coupled to the second end of the right-side elbow, so that the right-side ear bud stem is pivotable between insertion and removal positions about an axis parallel to the second end of the right-side elbow and crosses a tragus of the wearer's right ear when the right-side ear bud stem is pivoted to the insertion position;

a right-side ear bud coupled to the right-side ear bud stem so that pivoting the right-side ear bud stem to the insertion position causes the right-side ear bud to be inserted into a concha cavum of the wearer's right ear;

a hinge pivotally connecting the left-side head band and the right-side head band, the hinge including a spring configured to impart a retaining force to direct the second ends of the left-side and right-side head bands, respectively, toward the wearer's head when worn by the wearer;

a left-side temple support surface coupled to the left-side elbow, the left-side temple support surface adapted to transfer at least a portion of the force imparted from the spring to the left-side head band to a left temple region of the wearer's head when worn by the wearer so that the left-side ear bud stem freely pivots out of the insertion position while the left-side elbow remains in place; and a right-side temple support surface coupled to the right-side elbow, the right-side temple support surface adapted to transfer at least a portion of the force imparted from the spring to the right-side head band to a right temple region of the wearer's head when worn by the wearer so that the right-side ear bud stem freely pivots out of the insertion position while the right-side elbow remains in place; and a boom mountable to the second end of the left-side elbow or the second end of the right-side elbow at a first end of the boom such that the boom remains stationary during pivoting of the left-side ear bud stem and the right-side ear bud stem, the boom including a sound inlet for a microphone at a second, opposite end of the boom.

18. The stereo headset of claim 17, further comprising:

a first spring coupled to the left-side ear bud stem and the left-side elbow, the first spring biasing the left-side ear bud stem with respect to the left-side elbow to maintain the left-side ear bud stem in the insertion position;

a second spring coupled to the right-side ear bud stem and the right-side elbow, the second spring biasing the right-side ear bud stem with respect to the right-side elbow to maintain the right-side ear bud stem in the insertion position; and a third spring biasing the left-side head band and the right-side head band toward one another.

19. The stereo headset of claim 17, further comprising:

a left-side coupling rotatably joining the left-side ear bud to a left-side ear bud mounting location on the left-side ear bud stem so that rotation of the left-side ear bud about the left-side coupling causes the left-side ear bud to describe a portion of a cone around the left-side ear bud mounting location; and a right-side coupling rotatably joining the right-side ear bud to a right-side ear bud mounting location on the right-side ear bud stem so that rotation of the right-side ear bud about the right-side coupling causes the right-side ear bud to describe a portion of a cone around the right-side ear bud mounting location.

* * * * *